US005909166A

United States Patent [19]

Wecke et al.

[11] Patent Number: 5,909,166

[45] Date of Patent: Jun. 1, 1999

[54] SAFETY SWITCH

[75] Inventors: Rolf Wecke, Bückeburg; Heinz Scharlibbe, Hille; Dirk Dreyer, Stadthagen; Joachim Ulfik, Vlotho-Exter, all of Germany

[73] Assignee: Hans Bernstein Spezialfabrik für Schaltkontakte, Porta Westfalica, Germany

[21] Appl. No.: 09/054,150

[22] Filed: Apr. 2, 1998

[30] Foreign Application Priority Data

Apr. 10, 1997 [DE] Germany ..... 297 06 340

[51] Int. Cl.[6] ..... H01F 5/00; H01F 7/00; H01F 7/08

[52] U.S. Cl. ..... 335/267; 335/177; 335/178; 335/259

[58] Field of Search ..... 335/256, 259, 335/266, 267, 268, 177, 178, 181

[56] References Cited

U.S. PATENT DOCUMENTS 1,404,910 1/1922 Thompson ..... 335/267
1,767,058 6/1930 Eiseman ..... 335/267
4,065,096 12/1977 Frantz et al. ..... 251/137

FOREIGN PATENT DOCUMENTS 33 09 372 C2 9/1984 Germany .
37 10 079 C2 10/1988 Germany .
22 91 538 1/1996 United Kingdom .

*Primary Examiner*—M. L. Gellner
*Assistant Examiner*—Raymond Barrera
*Attorney, Agent, or Firm*—Henry M. Feiereisen

[57] ABSTRACT

A safety switch includes a spring-biased locking pin which is displaceable axially inside a switch housing by a lifting magnet against the biasing force of the spring to switch a switching element between a blocking position and a release position, and a retention magnet which holds the locking pin in the release position when the lifting magnet is de-energized.

10 Claims, 2 Drawing Sheets

SAFETY SWITCH

BACKGROUND OF THE INVENTION

The present invention generally relates to a safety switch, and in particular to a safety switch of a type having a spring-biased locking pin which can be displaced axially inside a switch housing by a lifting magnet in opposition to the biasing force of the spring into a position for releasing a switching element.

Various designs of safety switches with lifting magnets are known in the art. In general, the safety switch of this type is forced into the off-position when an actuating element is pulled out, whereby a compression spring which acts on the locking pin pushes the locking pin into a blocking position. The switching element which is typically constructed in the form of a switch wheel can be released by energizing the lifting magnet so that the armature thereof is displaced against the bias force of the compression spring to thereby move the locking pin into the release position.

In conventional safety switches, the lifting magnet is energized, i.e. current flows through the windings of the lifting magnet, until the locking pin moves again into the blocking position. The lifting magnet must be so dimensioned as to be able to generate the lifting force required to unlatch the locking pin. The lifting force, however, is significantly greater, typically about forty times greater, than the holding force required to retain the locking pin in the release position. A drawback of conventional safety switches is their substantial power consumption, and the significant heat build-up as a consequence of the high current flow.

SUMMARY OF THE INVENTION

It is thus an object of the present invention to provide an improved safety switch, obviating the afore-stated drawbacks.

In particular, it is an object of the present invention to provide an improved safety switch which consumes significantly less energy for holding the locking pin in the release position, while yet being of simple design.

These objects, and others which will become apparent hereinafter, are attained in accordance with the present invention by providing a spring-biased locking pin which is displaceable axially inside a switch housing by a lifting magnet against the biasing force of the spring to switch a switching element between a blocking position and a release position, and a retention magnet which holds the locking pin in the release position when the lifting magnet is de-energized.

Through the provision of an additional retention magnet, the operation of the safety switch is subdivided into a lifting work as executed by the lifting magnet, and a retention work as executed by the retention magnet. Since the retention magnet has to supply only the relatively small holding force, it consumes significantly less energy than the lifting magnet. In order to ensure a reliable operation of the switch, the retention magnet is energized before the lifting magnet is de-energized. The time intervals during which both magnets are energized consequently overlap.

Unlike conventional designs, the safety switch according to the present invention advantageously generates less heat because the windings of the retention magnet require less current than those of the lifting magnet. Further the safety switch according to the present invention is useful, regardless whether the safety switch is operated in normally-open mode or normally-closed mode.

According to another feature of the present invention, the armature of the lifting magnet and the armature of the retention magnet are articulated to one end of a rocking lever which extends transversely to the locking pin and conjointly moves with the locking pin, with the other opposite end of the rocking lever being pivotally supported about a stationary axis. When the lifting magnet is energized, the armature of the retention magnet moves in synchronism with the armature of the lifting magnet as a result of the constraint by jointly articulating both armatures to the rocking lever. This ensures that the rocking lever remains in the release position when the retention magnet is energized.

In accordance with another embodiment of the present invention, the retention magnet can also hold the armature of the lifting magnet in the release position of the locking pin, e.g. by fixedly securing a crossbar to the locking pin, with one end of a compression spring which holds the locking pin in the blocking position, bearing upon one end of the crossbar, and with the rocking lever contacting the other switching element distal end of the crossbar. A permanent connection between the rocking lever and the locking pin is here not required. The compression spring pushes the locking pin into the blocking position, when the retention magnet is no longer energized, with the rocking lever pivoting back to the starting position, and with the armatures of the lifting magnet and the retention magnet returning to the idle position. Suitably, the switching element distal end of the compression spring is supported by an inner stationary housing part which forms an abutment for the compression spring.

The inner housing part may be formed e.g. by a rib or intermediate wall which is oriented transversely to the locking pin. The locking pin can be effectively secured against rotation by guiding, preferably both end faces of the crossbar in oblong holes formed in guide plates, e.g. printed circuit boards, with the oblong holes extending in longitudinal direction of the locking pin. These plates are suitably positioned in close proximity to two parallel walls of the switch housing.

Preferably, the crossbar is located in a mid-area of the rocking lever to create favorable distribution of forces as the rocking lever acts as a one-armed lever, with the armatures of the lifting magnet and retention magnet being spaced from the locking pin. Further, since the distance between the lifting magnet and retention magnet, on the one hand, and the pivot axis of the rocking lever, on the other hand, is greater than the distance between the crossbar and the pivot axis, the travel of the armature of the lifting magnet and the travel of the armature of the retention magnet are greater than the displacement of the locking pin. The displacement of the locking pin is however so designed that the switching element, e.g. the switching wheel, is able to rotate. This rotation of the switching element generally displaces the locking pin further by a distance which is approximately equal to the difference between the travel of the armature of the lifting magnet and the displacement of the locking pin, so that the displacement of the locking pin in effect becomes identical to the travel of the armature of the lifting magnet.

Safety switches according to the present invention can be installed in various different orientations, depending on the specific application. In order to prevent the armature of the lifting magnet from spontaneously and inadvertently returning to a position which would leave the locking pin in the blocking position when the lifting magnet is de-energized, a bridge member is preferably provided which is fixedly attached to the locking pin and oriented transversely thereto, with the armature of the lifting magnet having a rocking lever distant end which is moveably guided in the bridge member. Thus, while the armature of the lifting magnet can move relative to the locking pin when the lifting magnet is energized, the armature of the lifting magnet is prevented from returning to the starting position before the locking pin returns to the blocking position, when the lifting magnet is de-energized.

According to still another feature of the present invention, the safety switch further includes a switching controller with pulse width modulation for providing a power supply for the lifting magnet and the retention magnet, allowing the safety switch to be used with different line voltages. The safety switch can thus be used with all power sources regardless of voltage, i.e. the safety switch can be used worldwide in spite of the different line voltages. In order to eliminate the need for additional coils for voltage control, it is suitable to design the inductive loads of the coils of the lifting magnet and the retention magnet as smoothing inductance.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
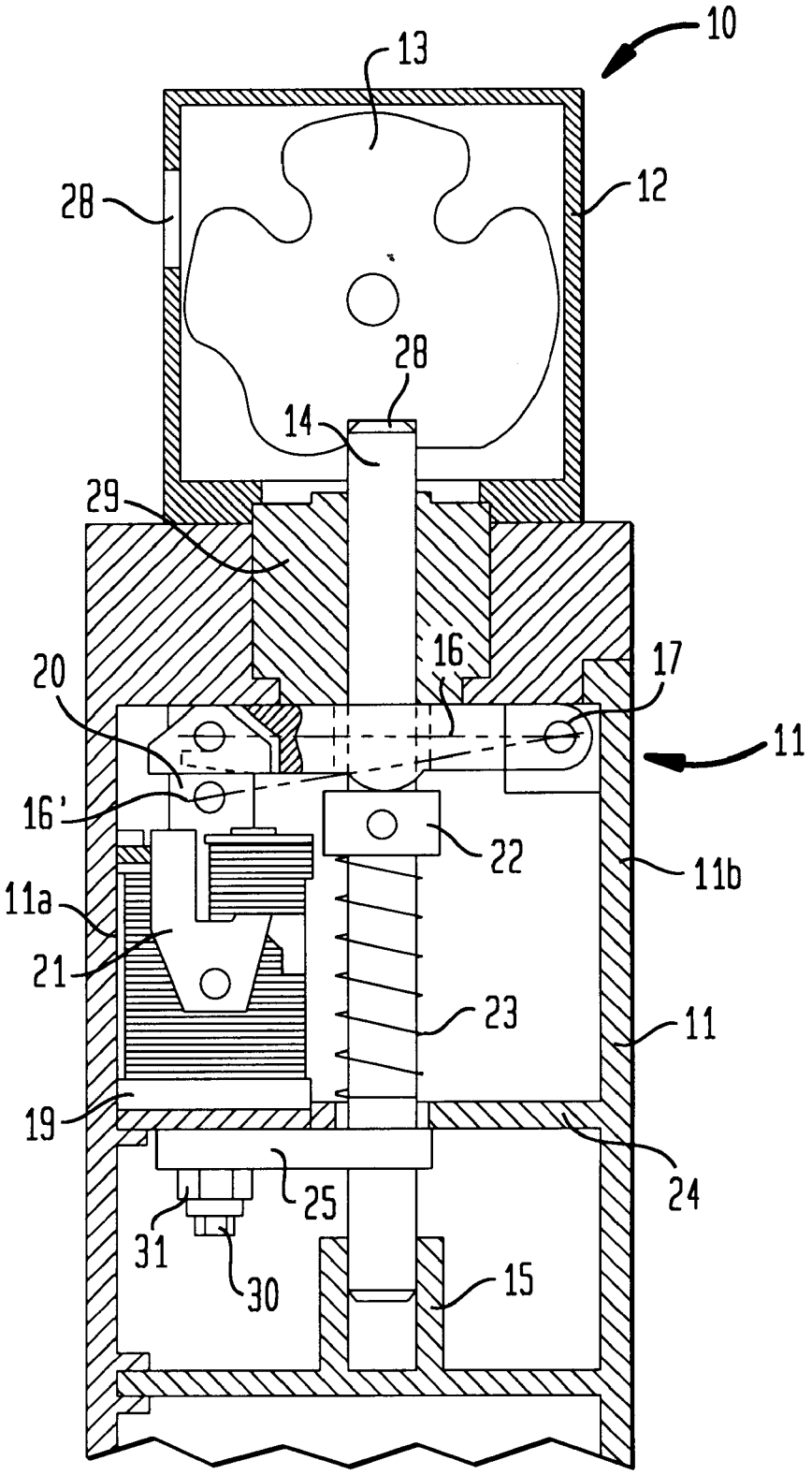
FIG. 1 is a partial sectional view of one embodiment of a safety switch according to the present invention.

Throughout all the Figures, same or corresponding elements are generally indicated by same reference numerals.

Turning now to the drawing, and in particular to FIG. 1, there is shown a partial sectional view of one embodiment of a safety switch according to the present invention, generally designated by reference numeral 10. The safety switch 10 has a housing, generally designated by reference numeral 11 and including a housing part 11*a* and a housing part 11*b* connected to one another via suitable receiving grooves. The housing part 11*a* carries on one end face a case 12 in which a switching element in the form of a switch wheel 13 is supported for rotation. The case 12 has an opening 28 for access of a suitable operating key of e.g. a radius actuator (not shown) to actuate the switch wheel 13 through rotation. Extending in a mid-area of the housing 11 is a locking pin 14 which is moveably supported therein for displacement in an axial direction i.e. in longitudinal direction of the locking pin 14. One end of the locking pin 14 is received in a bushing 29 trapped in the housing part 11*a* and protrudes from the housing 11 to engage in a complementary recess 28 of the switch wheel 13 when the safety switch 10 is in the blocked position shown in FIGS. 1 and 2. The other end of the locking pin 14 is guided in a tubular socket 15 formed integrally with the housing part 11*b*.

As shown in FIG. 1, the housing 11 accommodates in an area proximate to the switch wheel 13 a rocking lever 16 in the form of a one-armed lever which is pivotally supported at one end about a stationary axle 17 which is secured to the housing 11. Articulated to the other opposite end of the rocking lever 16 are the armature 18 of a lifting magnet 19 and the armature 20 of a retention magnet 21. A crossbar 22 which contacts the rocking lever 16 is rigidly attached to the locking pin 14. Depending on the installation position, the crossbar 22 is situated laterally next to the rocking lever 16 or below the rocking lever 16, i.e. on the switch wheel distant side of the rocking lever 16. The crossbar 22 supports one end of a compression spring 23 which surrounds the locking pin 14 and extends on the rocker lever distant side of the crossbar 22. The other end of the compression spring 23 is supported on a stationary wall 24 in the form of a rib or intermediate wall of the housing part 11*b*, with the locking pin 14 traversing the wall 24.

Also fixedly attached to the locking pin 14 is a bridge member 25 which is disposed on the compression spring distant side of the housing wall 24. On the side opposite to the rocking lever 16, the armature 18 of the lifting magnet 19 is provided with a screw thread 30 for threaded engagement by a nut 31, with the screw thread 30 extending through a bore of the bridge member 25. Thus, in the de-energized position of the lifting magnet 19 and when the retention magnet 21 is also not energized, the bridge member 25 bears against the intermediate wall 24, with the locking pin 14 engaging the recess 29 of the switch wheel 13, as shown in FIGS. 1 and 2, thereby blocking the switch wheel 13.

To initiate a switching operation, the lifting magnet 19 is energized first, to attract the armature 18 and to thereby pivot the rocking lever 16 by a relatively small angle, which is indicated in FIG. 1 by the dash-dot line 16'.

The displacement of the locking pin 14, although smaller than the travel of the armature 18 of the lifting magnet 19, is sufficient enough to permit a rotation of the switch wheel 13 so that the displacement of the locking pin 14 becomes then equal to or nearly equal to the stroke of the armature 18 when the switch wheel 13 is turned through insertion of e.g. the operating key of a radius actuator through the access opening 28. While the nut 31 disposed on screw thread 30 is first spaced from the bridge member 25, the subsequent rotation of the switch wheel 13 and ensuing further displacement of the locking pin 14 re-establishes a contact of the nut 31 upon the bridge member 25. This ensures that the armature 18 remains in this position regardless of the orientation in which the switch is installed, when the lifting magnet 19 is no longer energized. However, before the lifting magnet 19 is de-energized, the retention magnet 21 is energized so that the locking pin 14 remains in the release position. Once the retention magnet 21 is no longer energized, the compression spring 23 is then enabled to push the locking pin 14 into the blocking position.

Figure 2:
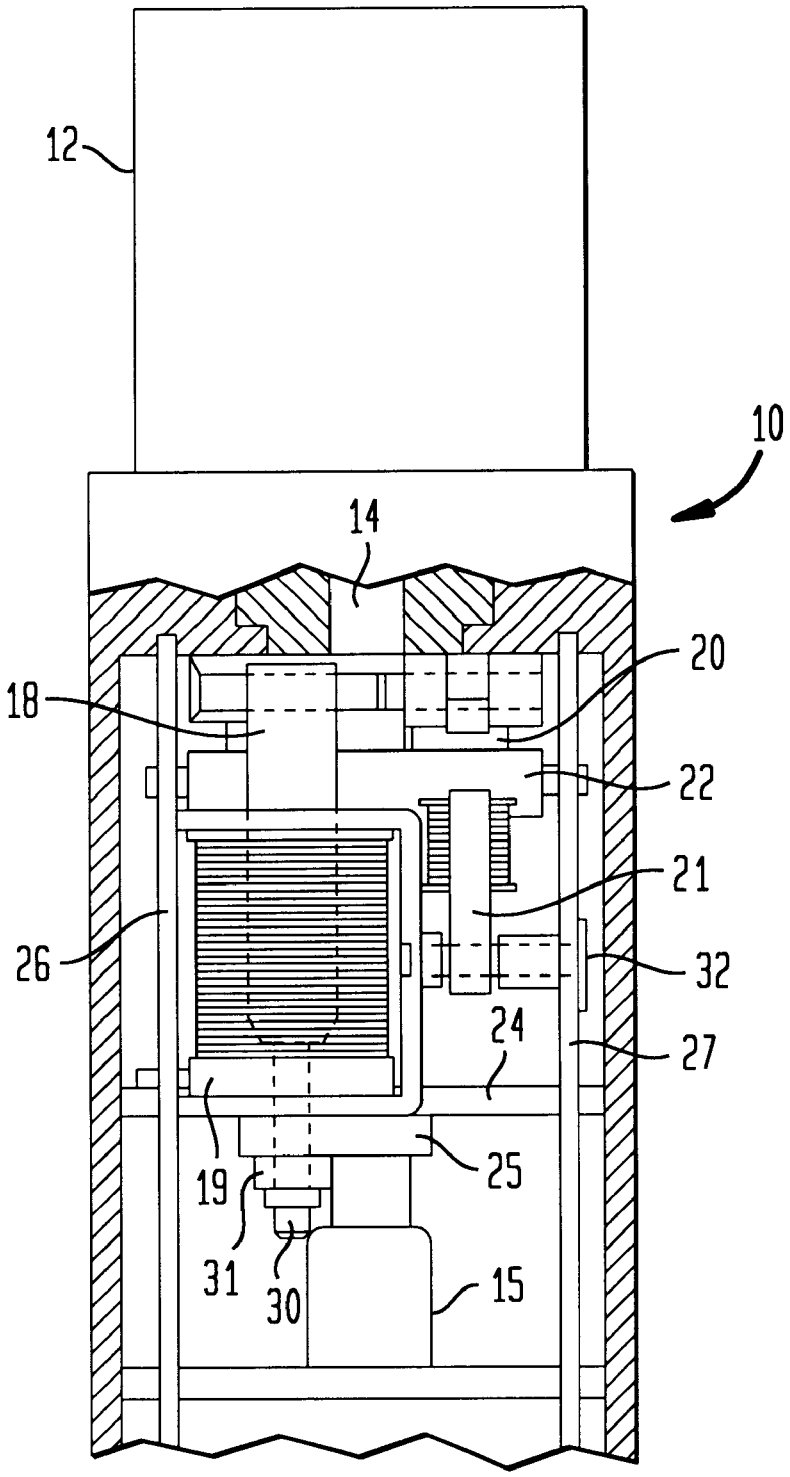
FIG. 2 is a partial sectional view of the safety switch rotated by 90° relative to the position of the safety switch in FIG. 1.

As best seen in FIG. 2, the housing 11 further accommodates therein two plates, e.g. circuit boards, 26, 27 in parallel adjacent relationship to two side walls of the housing part 11*a* and next to the lifting magnet 19 and the retention magnet 21. The plates 26, 27 are formed with oblong holes for supporting journals of the crossbar 22, with the retention magnet 21 being secured to the plate 27 by a bolted connection 32. The oblong holes of the plates 26, 27 extend in the longitudinal direction of the locking pin 14 and define the path of displacement of the crossbar 22.

Although not shown in the drawing in detail, the safety switch may further include a switching controller with pulse width modulation for providing a power supply for the lifting magnet 19 and the retention magnet 21, allowing the safety switch 10 to be used with different line voltages. The safety switch 10 can thus be used with all power sources regardless of voltage, i.e. the safety switch can be used worldwide in spite of the different line voltages. In order to eliminate the need for additional coils for voltage control, it is suitable to design the inductive loads of the coils of the lifting magnet and the retention magnet as smoothing inductance.

While the invention has been illustrated and described as embodied in a safety switch, it is not intended to be limited to the details shown since various modifications and structural changes may be made without departing in any way from the spirit of the present invention.

What is claimed as new and desired to be protected by Letters Patent is set forth in the appended claims:

1. A safety switch, comprising:

a housing accommodating a switching element;

a locking pin axially movable in the housing between a first position for blocking the switching element and a second position for releasing the switching element;

a spring element for urging the locking pin into the first position;

a lifting magnet for moving the locking pin into the second position against a biasing force of the spring element, said lifting magnet including a lifting armature;

a retention magnet for holding the locking pin in the second position when the lifting magnet is de-energized, said retention magnet including a holding armature; and a rocking lever oriented perpendicular to the locking pin and so designed as to conjointly move with the locking pin, said rocking lever having opposite ends, with said lifting armature and said retention armature being articulated to one of the ends of the rocking lever, and with the other one of the ends of the rocking lever being pivotally supported about a stationary axis.

2. The safety switch of claim 1, and further comprising a crossbar fixedly secured to the locking pin, said spring element having one end resting against a switching element distal end of the crossbar for urging the locking pin into the first position, said rocking lever bearing upon a switching element proximal end of the crossbar.

3. The safety switch of claim 2 wherein the housing has an inner housing part, said spring element having another switching element distant end supported on the housing part.

4. The safety switch of claim 2 wherein the spring element is a compression spring.

5. The safety switch of claim 2, and further comprising a plate assembly received in the housing and having oblong holes for supporting the crossbar, said oblong holes being oriented in a longitudinal direction of the locking pin.

6. The safety switch of claim 5 wherein the plate assembly includes two plates in spaced-apart disposition for supporting both end faces of the crossbar.

7. The safety switch of claim 2 wherein the crossbar is located in a mid-area of the rocking lever.

8. The safety switch of claim 1, and further comprising a bridge member fixedly secured to the locking pin and oriented transversely thereto, said lifting armature having a rocking lever distant end which is moveably guided in the bridge member.

9. The safety switch of claim 1, and further comprising a switching controller with pulse width modulation for providing a power supply for the lifting magnet and the retention magnet.

10. The safety switch of claim 1 wherein the lifting magnet includes a first coil and the retention magnet includes a second coil, said first and second coils each having an inductance in the form of a smoothing inductance.

* * * * *